US012290148B2

(12) United States Patent
Diard et al.

(10) Patent No.: US 12,290,148 B2
(45) Date of Patent: May 6, 2025

(54) FOOTWEAR WITH DOUBLE LACING SYSTEM

(71) Applicant: DECKERS OUTDOOR CORPORATION, Goleta, CA (US)

(72) Inventors: Jean-Luc Diard, Santa Barbara (FR); Vincent Bouillard, Ventura (FR); Christophe Aubonnet, Tresserve (FR); Thibaut Poupard, Annecy (FR)

(73) Assignee: DECKERS OUTDOOR CORPORATION, Goleta, CA (US)

( * ) Notice: Subject to any disclaimer, the term of this patent is extended or adjusted under 35 U.S.C. 154(b) by 47 days.

(21) Appl. No.: 17/410,865

(22) Filed: Aug. 24, 2021

(65) Prior Publication Data

US 2023/0061765 A1 Mar. 2, 2023

(51) Int. Cl.

| | |
|---|---|
| ***A43C 1/00*** | (2006.01) |
| ***A43B 23/02*** | (2006.01) |
| ***A43C 11/00*** | (2006.01) |

(52) U.S. Cl.

CPC ..... *A43C 1/00* (2013.01); *A43B 23/0245* (2013.01); *A43C 11/004* (2013.01); *A43B 23/0235* (2013.01); *A43B 23/026* (2013.01)

(58) Field of Classification Search

CPC ..... A43C 1/00; A43C 11/004; A43B 23/025; A43B 23/0235; A43B 23/026; A43B 23/0245

See application file for complete search history.

(56) References Cited

U.S. PATENT DOCUMENTS

| | | | | |
|---|---|---|---|---|
| 5,042,120 | A | 8/1991 | Nichols | |
| D348,764 | S * | 7/1994 | Teague | D2/907 |
| D642,370 | S * | 8/2011 | Dolan | D2/972 |
| 9,854,873 | B2 | 1/2018 | Kerns et al. | |
| 10,098,417 | B2 | 10/2018 | Klug et al. | |
| 2008/0216351 | A1 | 9/2008 | Carroll et al. | |
| 2011/0197475 | A1* | 8/2011 | Weidl | A43B 23/0235 36/107 |
| 2012/0011744 | A1* | 1/2012 | Bell | A43B 23/0245 36/91 |
| 2012/0124866 | A1* | 5/2012 | Moriyasu | A43C 1/003 36/83 |
| 2016/0174661 | A1* | 6/2016 | Nonogawa | A43B 23/0235 36/88 |
| 2016/0345673 | A1* | 12/2016 | Humphrey | A43C 19/00 |
| 2017/0172255 | A1 | 6/2017 | Ramos | |
| 2018/0035759 | A1* | 2/2018 | Pollack | A43C 11/165 |
| 2020/0329819 | A1* | 10/2020 | Durand | A43B 1/04 |

* cited by examiner

*Primary Examiner* — Sally Haden
*Assistant Examiner* — Giao Qt Hoang
(74) *Attorney, Agent, or Firm* — Greer, Burns & Crain, Ltd

(57) ABSTRACT

An article of footwear including a sole, and an upper having a lateral side and a medial side, each including a first lace opening. A lateral lace support and a medial lace support are attached to the sole and positioned adjacent to inner surfaces of the lateral and medial sides of the upper. The lateral lace support has a first length and the medial support has a second length, where the second length is greater than the first length, and each include a second lace opening. A lace is threaded through the first lace openings of the upper and the second lace openings of the lateral lace support and the medial lace support, where an axis extending between the lateral lace support and the medial lace support, after the lace is secured to the upper, is offset from an axis extending from a center of gravity of a user's foot.

8 Claims, 7 Drawing Sheets

FOOTWEAR WITH DOUBLE LACING SYSTEM

BACKGROUND

The present application relates generally to footwear, and more particularly, to a lacing system for an article of footwear that secures the article of footwear to a user's foot in a way that follows the natural contour and shape of the user's foot to provide enhanced comfort and balance to the user's feet while walking, jogging and running.

There are different lacing systems for footwear that are aimed at securing the footwear to a user's feet. Traditional lacing systems use a fabric lace in which the ends of the lace are threaded through opposing eyelets in a criss-cross manner on an upper of a shoe and then tied together to keep the laces from loosening. This lacing system requires that the user pull on each end of the lace until a desired tightness of the shoe relative to their foot is achieved.

Another lacing system includes a lace made of a stretchable material that is threaded through the eyelets of a shoe as described above and the ends of the lace are secured together as a loop. A locking mechanism is attached to the loop and enables a user to pull the loop through the locking mechanism until a desired tightness is achieved. The locking mechanism locks in position on the lace to maintain the desired tightness. The lace is loosened by activated a release device on the locking mechanism. This lacing system provides a quick and easy way to secure a shoe to a user's foot without the chance of the lace becoming untied and loosened during movement as with the traditional lacing system.

Although these lacing systems are sufficient to secure a shoe to a user's foot, the laces in these systems are configured so that the laces are positioned along the central longitudinal axis of the upper of the shoe. The shape of a human foot, however, is not symmetrical. The laces therefore in conventional lacing systems are not positioned sufficiently along the top of a user's foot to provide enhanced comfort, stability and balance to the user's feet during walking, jogging and running.

Therefore, it is desirable to provide footwear having a lacing system with laces positioned along the top of a user's foot in which the lacing system follows the natural contour and shape of the user's foot to provide enhanced comfort, stability and balance to the user's feet when wearing the footwear.

SUMMARY

The present article of footwear has a lacing system that follows the contour and shape of a user's feet to sufficiently secure the footwear to the user's feet while providing enhanced comfort, stability and balance during walking, jogging and running.

In an embodiment, an article of footwear is provided and includes a sole, and an upper having a lateral side and a medial side, each including a first lace opening. A lateral lace support and a medial lace support are attached to the sole and positioned adjacent to inner surfaces of the lateral and medial sides of the upper. The lateral lace support has a first length and the medial lace support has a second length, where the second length is greater than the first length, and each include a second lace opening. A lace is threaded through the first lace openings of the upper and the second lace openings of the lateral lace support and the medial lace support, where an axis extending between the lateral lace support and the medial lace support, after the lace is secured to the upper, is offset from an axis extending from a center of gravity of a user's foot.

In another embodiment, an article of footwear is provided that includes a sole and an upper attached to the sole. The upper includes a lateral side and a medial side, where the lateral side and the medial side of the upper each include a plurality of first connecting tabs having a first lace opening, and a lateral lace support and a medial lace support attached to the sole and respectively positioned adjacent to an inner surfaces of the lateral side and the medial side of the upper, where the lateral lace support has a first length and the medial support has a second length, where the second length is greater than the first length, and where the lateral and medial lace supports each include a plurality of second connecting tabs having a second lace opening. In this embodiment, the first connecting tabs of the upper and the second connecting tabs of the lateral and medial lace supports are alternatingly arranged along the lateral and medial sides of the upper. A lace is threaded through the first lace openings of the first connecting tabs and the second lace openings of the second connecting tabs to secure the lace to the upper, where an axis extending between the lateral lace support and the medial lace support, after the lace is secured to the upper, and the lateral and medial lace supports, is offset from an axis extending from a center of gravity of a user's foot.

DETAILED DESCRIPTION

Figure 1:
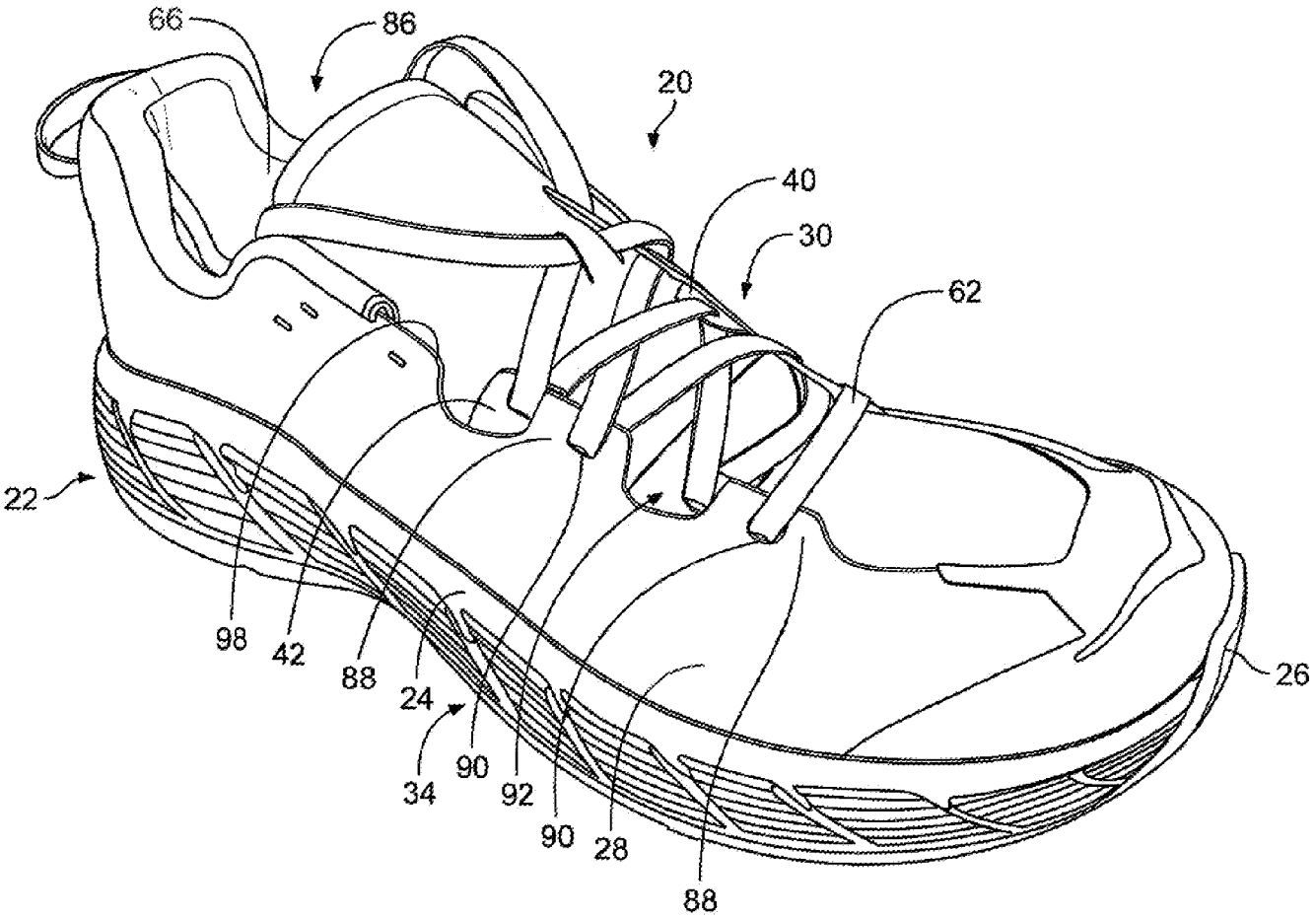
FIG. 1 is a perspective view of an embodiment of the present lacing system on an article of footwear.
Figure 2:
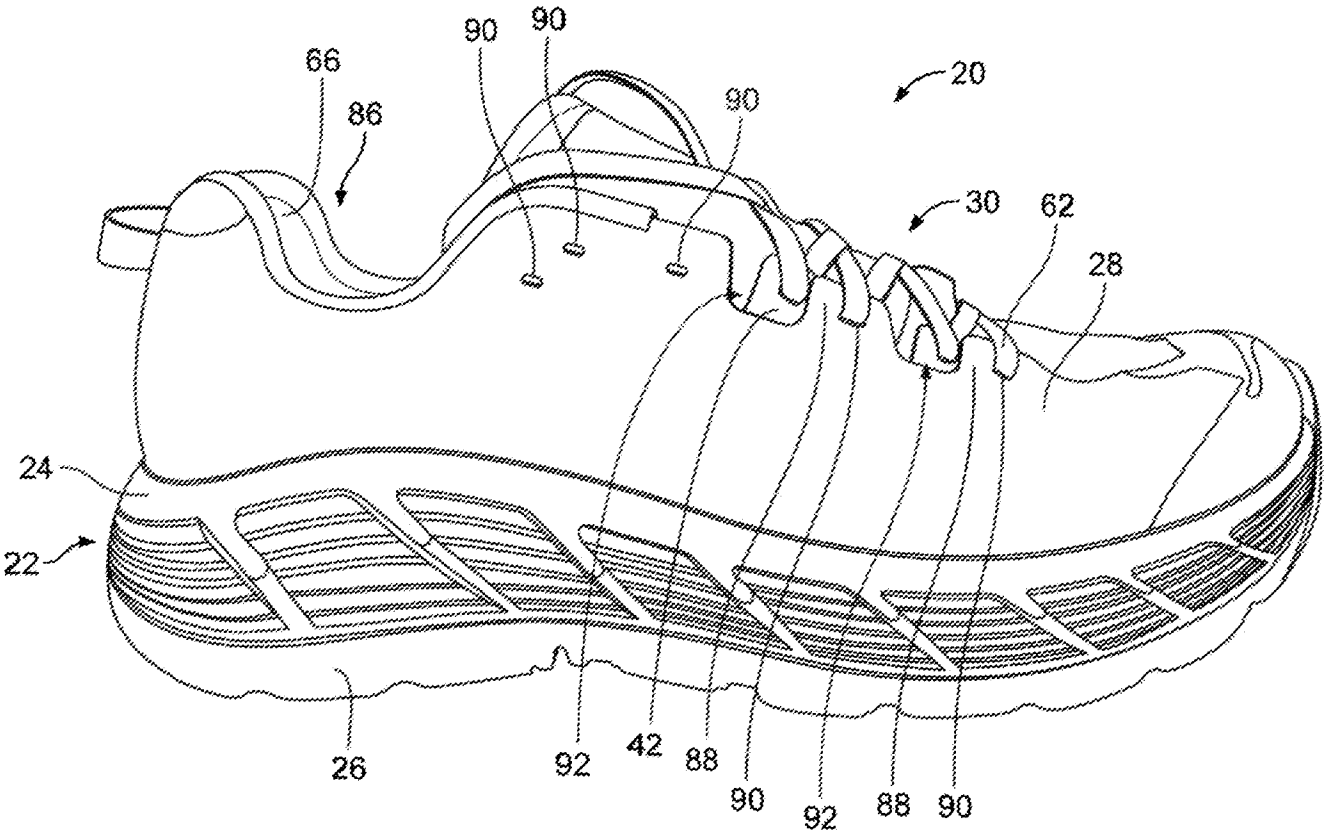
FIG. 2 is a right side view of the article of footwear of FIG. 1.
Figure 3:
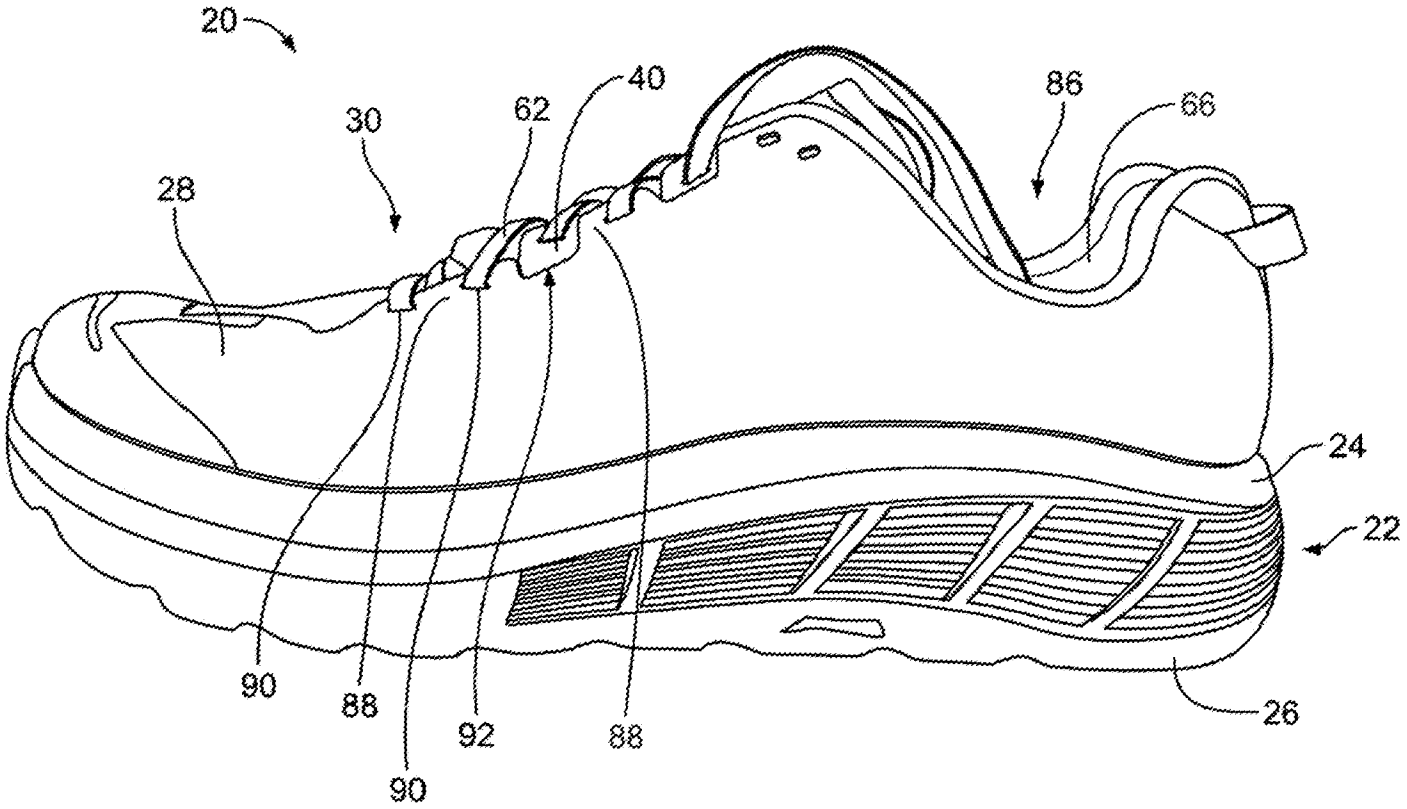
FIG. 3 is a left side view of the article of footwear of FIG. 1.

The present article of footwear includes a lacing system attached to an upper that positions a lace on the foot such that the lace mirrors the asymmetrical shape of the foot thereby providing enhanced comfort and stability to the foot. More specifically, the present lacing system includes a lace threaded through side lace supports that are asymmetrical along the longitudinal axis of the article of footwear or shoe. In other words, the lace is positioned on the shoe so that the central axis of the lacing system, i.e., the axis extending through the points where the lace crosses over itself, is located closer to the lateral side than the medial side of the shoe.

Referring now to FIGS. 1-7C, an embodiment of the present article of footwear or shoe, generally indicated as 20, includes a sole 22 having a midsole 24 and an outsole 26, and an upper 28 attached to the sole. As stated above, a lacing system 30 is secured to the upper 28 so that an axis 32 of the lacing system 30 is located closer to the lateral side 34 than the medial side 36 of the shoe 20 to mirror the contour and shape of a user's foot, where a greater portion of the user's foot is located toward the lateral side than the medial side relative to the axis 38 extending through the center of gravity of the user's foot. The configuration of the axis 32 of the lacing system 30 being offset from the axis 38, i.e., a distance from the axis 38 toward the lateral side 34 of the shoe 20, enhances the comfort and stability to the user's foot since the upper 28 more closely follows the contour and shape of the user's foot.

Figure 6A:
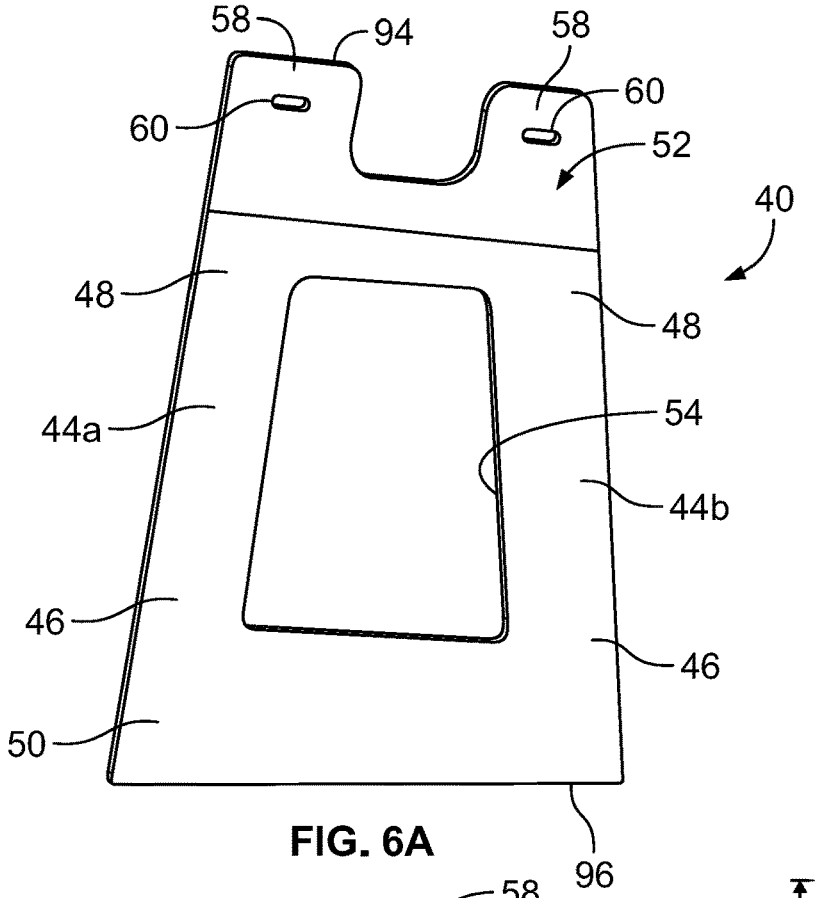
FIG. 6A is rear view of the medial lace support of the present lacing system.
Figure 7A:
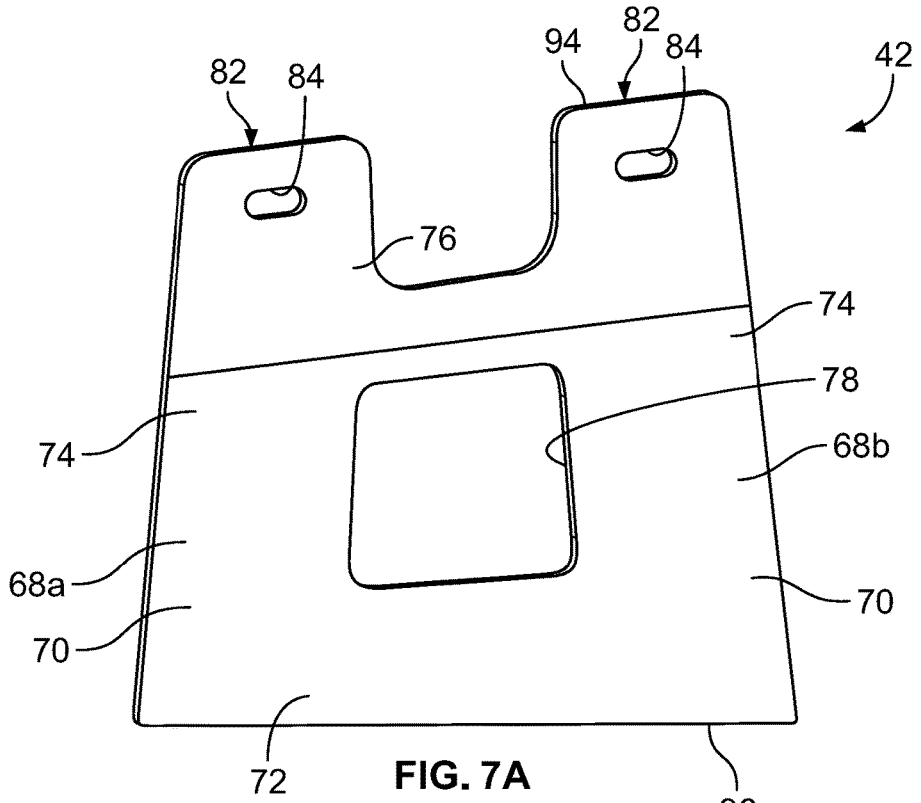
FIG. 7A is rear view of the lateral lace support of the present lacing system.

Referring to FIGS. 6A and 7A, the present lacing system 30 includes a medial lace support 40 and a lateral lace support 42. As shown, the medial lace support 40 has two support members 44*a* and 44*b*, each having a first end 46 and a second end 48. The first ends 46 of the support members 44*a*, 44*b* are attached to a base 50 and the opposing second ends 48 are attached to a lace support member 52.

Figure 6B:
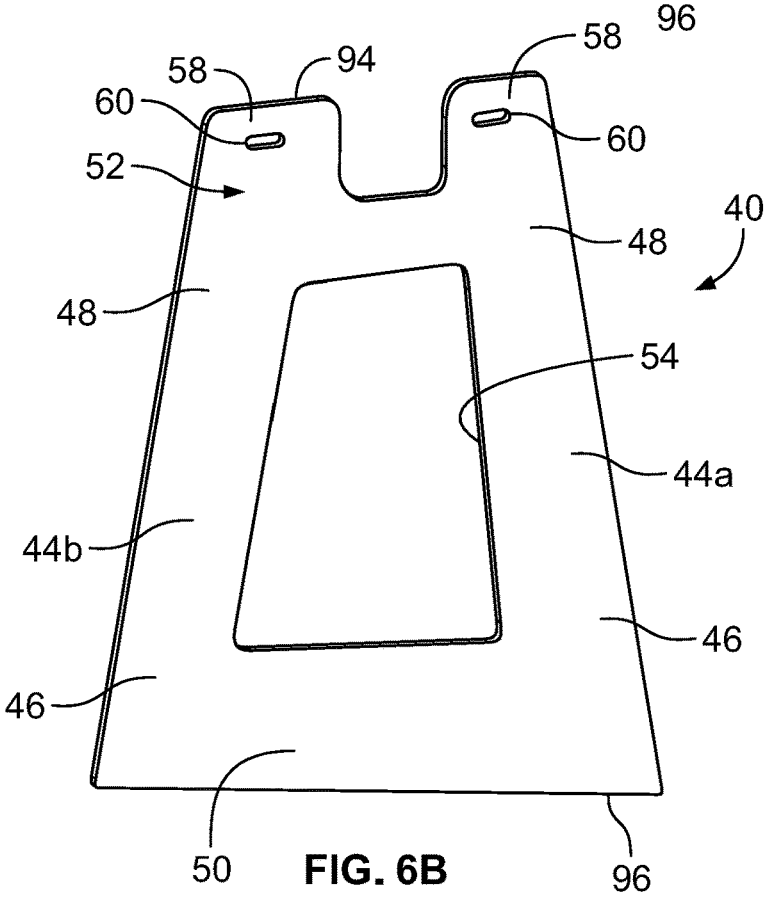
FIG. 6B is front view of the medial lace support of FIG. 6A.
Figure 6C:
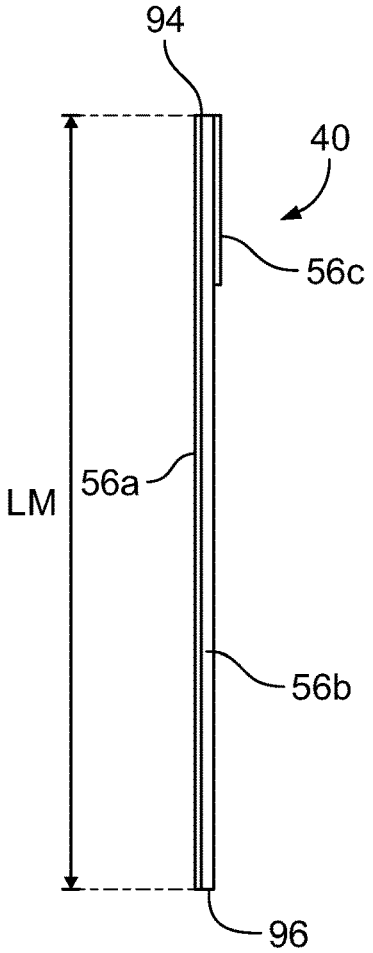
FIG. 6C is a side view of the medial lace support of FIG. 6A.

In FIGS. 6A, 6B and 6C, the medial lace support 40 includes a central opening 54 that decreases the material needed to make the medial lace support while providing sufficient flexibility for the medial lace support to extend along and over a user's foot. In the illustrated embodiment, the medial lace support 40 is made of three material layers 56*a*, 56*b* and 56*c*. The first material layer 56*a* is made of a stretchable material, that extends along the entire length LM (distance between the base 50 and the highest point of the lace support member 52) of the medial lace support 40. In an embodiment, the first material layer 56*a* is a thin rubber layer. The second material layer 56*b* is attached to the first material layer 56*a* by adhesive, stitching or another suitable attachment method. The second material layer 56*b* is preferably a nylon material that extends along the entire length LM of the medial lace support 40 to provide sufficient support and strength for the medial lace support. To reinforce the end of the medial lace support 40, a third material layer 56*c* is attached to the second material layer 56*b* along a portion of the lace support member 52. As shown in FIG. 6A, the lace support member 52 includes a pair of spaced apart connecting tabs 58 with lace openings 60 through which a shoelace or lace 62, is threaded along the upper 28. The third material layer 56*c* is preferably a thin rubber material that provides flexibility and enhanced support to the lace support member 52 to help withstand the forces generated by the threading and tightening of the lace 62 relative to the medial lace support 40. It should be appreciated that the first, second and third material layers 56*a*, 56*b* and 56*c*, may be any suitable material or combination of materials. In this embodiment, the base 50 of the medial lace support 40 at least partially extends under the footbed 64 and is secured to at least one of the footbed and sole 22 by stitching. Additionally, at least a portion of the base 50 is secured to at least one of the footbed 64, midsole 24 and an inside surface 66 of the upper 28 by an adhesive.

Figure 7B:
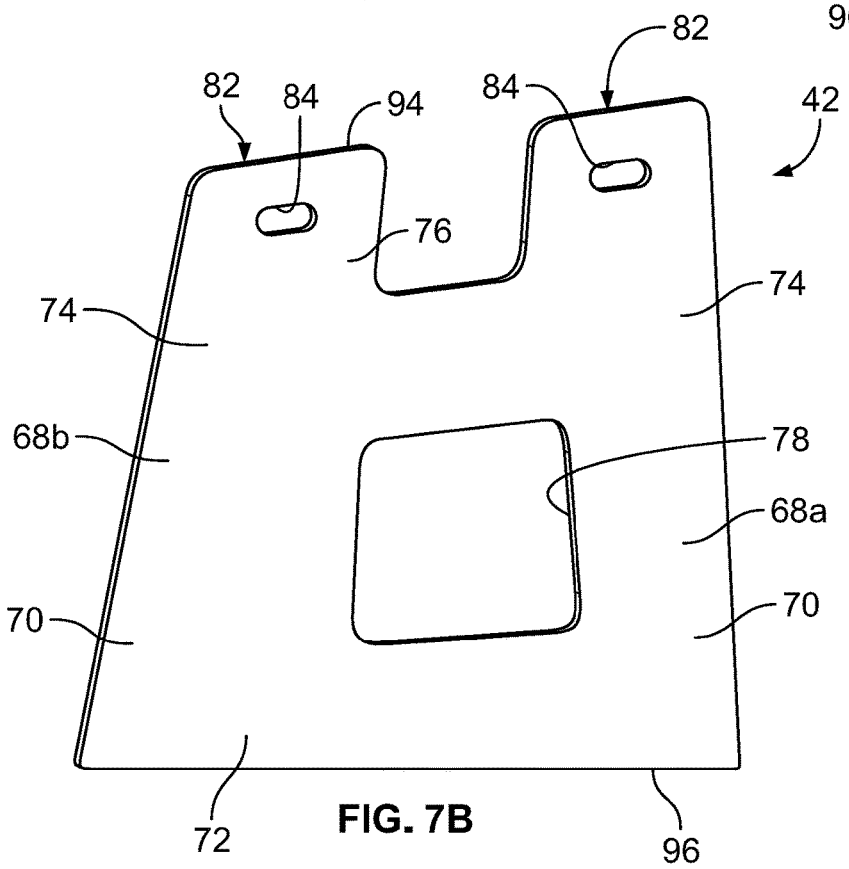
FIG. 7B is front view of the lateral lace support of FIG. 7A.
Figure 7C:
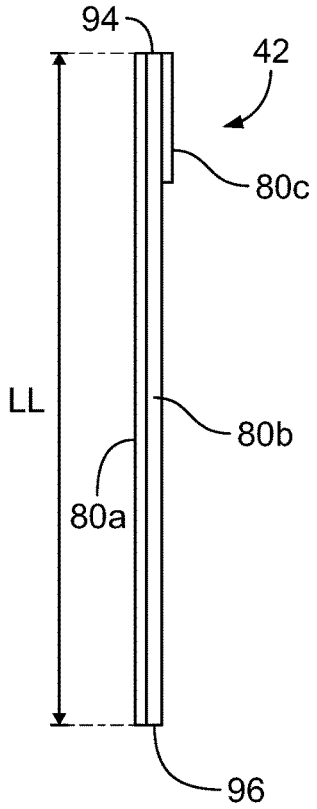
FIG. 7C is a side view of the lateral lace support of FIG. 7A.

Referring to FIGS. 7A, 7B and 7C, the lateral lace support 42 is similar to the medial lace support 40, and includes two support members 68*a* and 68*b*. A first end 70 of the support members 68*a*, 68*b* is attached to a base 72 and a second, opposing end 74 is attached to a lace support member 76. A central opening 78 is formed in the lateral lace support 42 to reduce the material of the lateral lace support while providing flexibility to enable the medical lace support to conform to and stretch over the user's foot. As shown in FIG. 7C, the lateral lace support 42 is made of three material layers 80*a*, 80*b* and 80*c*. The three material layers 80*a*, 80*b* and 80*c* are the same material layers that form the lateral lace support 42. Specifically, the first material layer 80*a* is made of a thin rubber material and extends along the entire length LL (distance between the base 72 and the highest point of the lace support member 76) of the lateral lace support 42. The second material layer 80*b* is made of a nylon material that is attached to the first material layer 80*a* by an adhesive, stitching or another attachment method, and extends along the length LL of the lateral lace support 42. The third material layer 80*c* is made of a thin rubber material and is attached to the second material layer 80*b* along a portion of the lace support member 76. As shown in FIGS. 7A and 7B, the lace support member 76 includes two spaced connecting tabs 82, each having a lace opening 84, through which the lace 62 is threaded and secured to the lateral lace support 42. It should be appreciated that the first, second and third material layers 80*a*, 80*b* and 80*c* forming the lateral lace support 42 may be any suitable material or combination of materials. At least a portion of the base 72 of the lateral lace support 42 extends at least partially under the footbed 64 and is attached to at least one of the footbed 64, the sole 22 and the inner surface of the upper by stitching, an adhesive or another suitable attachment method.

In the embodiments of the medial and lateral lace supports 40, 42 discussed above, the medial and lateral lace supports each include a top edge or top surface 94 and a bottom edge or bottom surface 96, where the top edge and the bottom edge are not parallel to each other. This configuration enables the bottom edges 96 of the medial and lateral lace supports 40, 42 to align with and be secured to the footbed 64 and sole 22 of the shoe 20, and the top edges 94 to align with the longitudinal opening 98 in the shoe 20 extending from the foot opening 86. It should be appreciated that the top edges 94 of the medial and lateral lace supports may be parallel to the bottom edges 96 or at any suitable angle relative to the bottom edges 96 of the medial and lateral lace supports.

Figure 4:
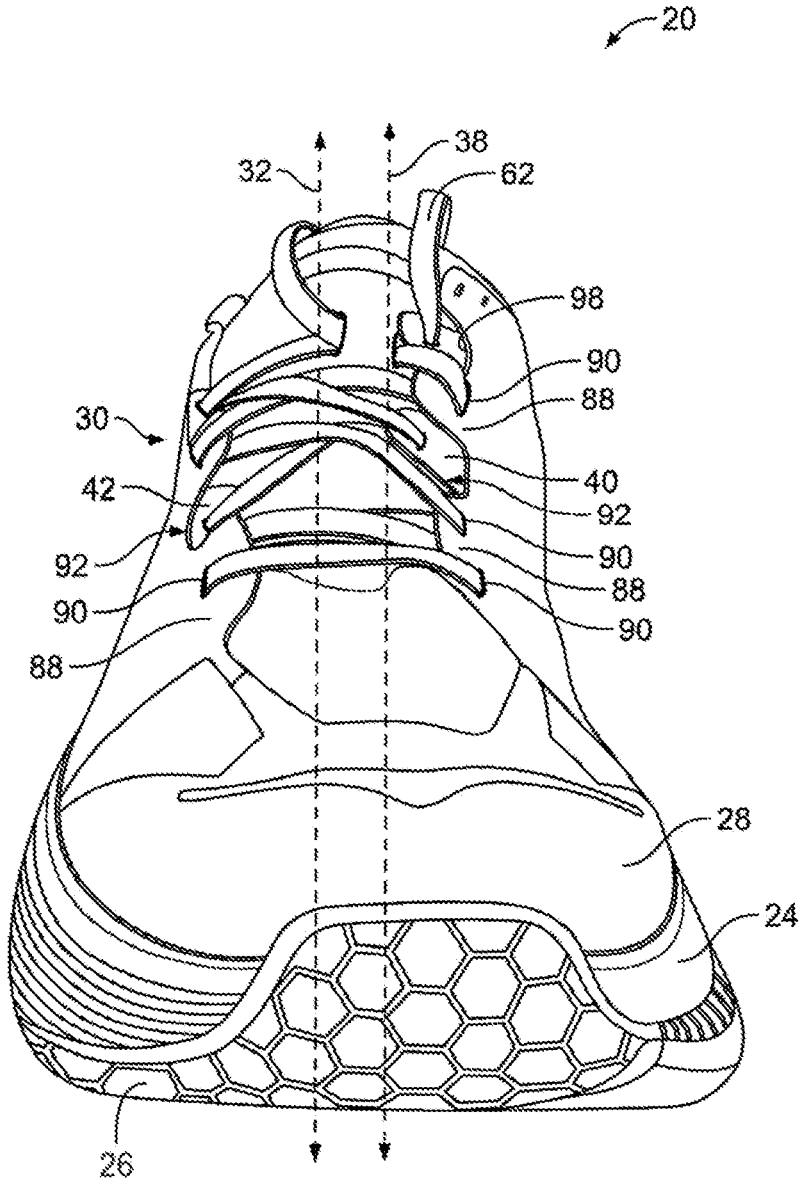
FIG. 4 is a front view of the article of footwear of FIG. 1.
Figure 5:
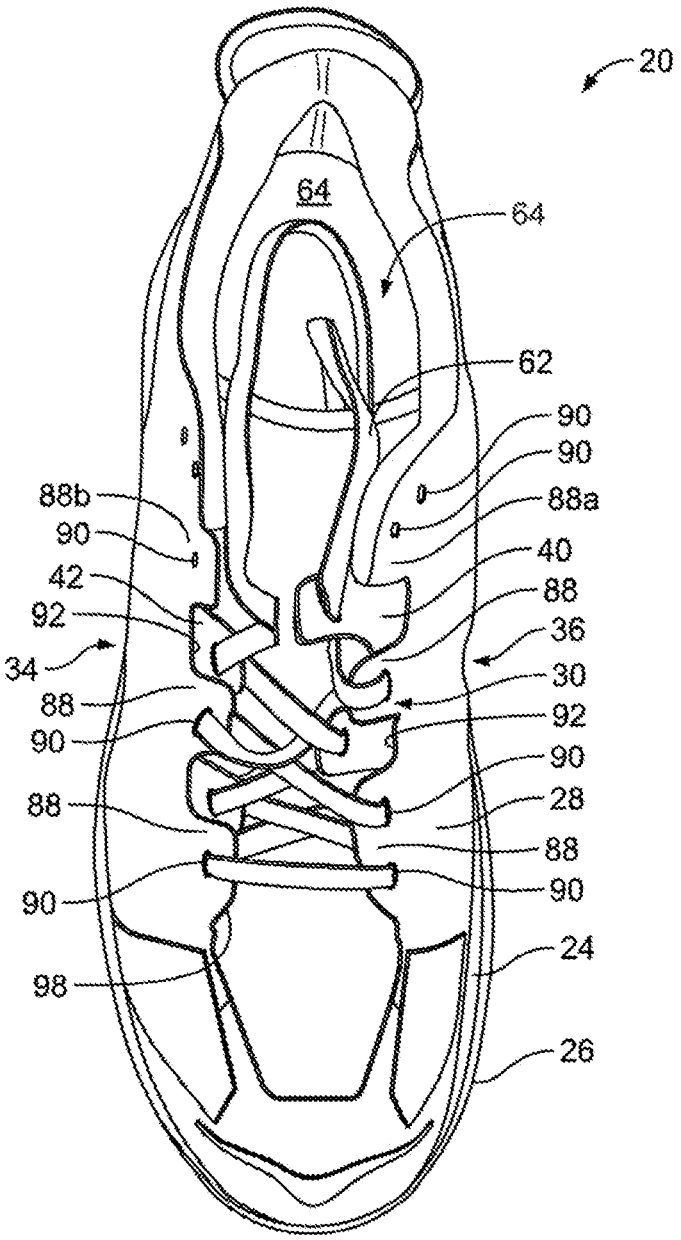
FIG. 5 is a top view of the article of footwear of FIG. 1.

To closely follow the contour and shape of a user's foot, the medial lace support 40 is positioned closer to the foot opening 86 of the shoe 20 than the lateral lace support 42. In this way, the medial lace support 40 and the lateral lace support 42 are asymmetrical relative to each other along the axis 38 of the shoe 20. Furthermore, the length LM of the medial lace support 40 is greater than the length LL of the lateral lace support 42. The asymmetrical positioning and the longer length of the medial lace support 40 positions the medial lace support over at least a portion of the top of a user's foot such that the axis 32 of the lacing system 30 is closer to the lateral side 34 than the medial side 36 of the shoe 20 as shown in FIGS. 4 and 5.

In the illustrated embodiment, opposing sides 34 and 36 of the upper 28 include lace connecting tabs 88 that are spaced apart along the length of the upper. Each of the lace connecting tabs 88 includes a lace opening 90 for receiving the lace 62. The end lace connecting tab that is closest to the foot opening 86 includes three lace openings 90 for adjusting the position of the lace 62 relative to a user's ankle. In this way, the fit of the shoe 20 on the user's foot may be adjusted to enhance comfort and stability. It should be appreciated that the lace connecting tabs 88 may each have one or more lace openings 90. For example, as shown in FIG. 5, the first lace connecting tab 88*a* on the medial side 36 of the shoe 20 includes two lace openings 90 whereas the first lace connecting tab 88*b* on the lateral side 34 of the shoe 20 includes one lace opening 90.

As shown in FIGS. 1-3 and 5, the medial and lateral lace supports 40, 42 are positioned and attached to the shoe 20 so that the connecting tabs 58, 82 of the medial and lateral lace supports 40, 42 are located in the spaces 92 between the connecting tabs 88 on the opposing sides of the upper 28. In this way, the medial and lateral lace supports 40, 42 extend along the inside surfaces 66 of the sides 34, 36 of the upper 28 and provide additional support to the sides of the upper. It should be appreciated that the connecting tabs 58, 82 of the medial and lateral lace supports 40, 42 may be positioned in the spaces 92 between the connecting tabs 88 of the sides of the upper 28 or be positioned in the same locations as the connecting tabs 88 to reinforce the connecting tabs 88 and provide enhanced strength and durability to the connecting tabs of the upper. It should be further appreciated that the medial and lateral lace supports 34, 36 may include one or a plurality of connecting tabs 58, 82 depending on the length of the shoe 20 and/or the desired stability and support of the shoe on a user's foot.

In the above embodiments, the shoe 20 has one medial lace support 40 and one lateral lace support 42. It is contemplated that the shoe 20 may include one or a plurality of medial and lateral lace supports 40, 42 along the length of the upper. Further, each medial and lateral lace support may include one or a plurality of the connecting tabs 58, 82 for securing the lace 62 to the upper 28 of the shoe 20.

While particular embodiments of the present lacing system are shown and described, it will be appreciated by those skilled in the art that changes and modifications may be made thereto without departing from the invention in its broader aspects and as set forth in the following claims.

What is claimed is:

1. An article of footwear comprising:

a sole;

an upper attached to said sole, said upper including a lateral side and a medial side, said lateral side and said medial side of said upper each including a plurality of lace connecting tabs, wherein each of said lace connecting tabs include at least one first lace opening, said lace connecting tabs being spaced from each other and defining open-ended spaces between said lace connecting tabs;

a lateral lace support and a medial lace support attached to said sole and respectively positioned adjacent to an inner surface of said lateral side and said medial side of said upper, said lateral lace support and said medial lace support being positioned in said open-ended spaces of said lateral side and said medial side of said upper, said lateral lace support having a first length and said medial support having a second length, wherein said second length is greater than said first length, and said lateral and medial lace supports each including two support connecting tabs that are spaced apart, and said two support connecting tabs each have at least one second lace opening, a top edge of each of said two support connecting tabs being substantially straight and a bottom edge of said lateral lace support and said medial lace support being a continuous, substantially straight edge, wherein said top edges of said two supporting connecting tabs and said bottom edges of said lateral lace support and said medial lace support are not parallel to each other and wherein a width of a bottommost end of said lateral lace support and said medial lace support is greater than a width of any other portion of said lateral lace support and said medial lace support, said lateral lace support and said medial lace support each including a single, opening between said top edges and said bottom edges; and a lace threaded through said at least one first lace opening of said lateral side and said medial side of said upper and through said at least one second lace opening of said lateral lace support and said medial lace support, wherein after said lace is secured to said upper and said lateral and medial lace supports, a first longitudinal axis extending between said lateral lace support and said medial lace support and through all points where said lace crosses over itself, is offset from a second longitudinal axis extending between a medial side and a lateral side of said sole and along a center of gravity of a user's foot.

2. The article of footwear of claim 1, wherein said lateral lace support and said medial lace support each include two connecting tabs spaced from each other, each of said two connecting tabs having said at least one second lace opening.

3. The article of footwear of claim 1, wherein said lace support member includes a pair of connecting tabs, each of said connecting tabs having at least one of said second lace openings.

4. The article of footwear of claim 1, wherein said lateral lace support and said medial lace support are each formed by three material layers.

5. An article of footwear comprising:

a sole;

an upper attached to said sole, said upper including a lateral side and a medial side, said lateral side and said medial side of said upper each including a plurality of first connecting tabs each having a first lace opening, said plurality of first connecting tabs being spaced apart and defining a plurality of open-ended spaces between said first connecting tabs;

a lateral lace support and a medial lace support attached to said sole and respectively positioned adjacent to an inner surface of said lateral side and said medial side of said upper positioned in said open-ended spaces of said lateral side and said medial side of said upper, said lateral lace support having a first length and said medial lace support having a second length, wherein said second length is greater than said first length, said lateral and medial lace supports each including two support connecting tabs that are spaced apart, and said two support connecting tabs each have at least one second lace opening, a top edge of each of said two support connecting tabs being substantially straight and a bottom edge of said lateral lace support and said medial lace support being a continuous, substantially straight edge, wherein said top edges of said two supporting connecting tabs and said bottom edges of said lateral lace support and said medial lace support are not parallel to each other and wherein a width of a bottommost end of said lateral lace support and said medial lace support is greater than a width of any other portion of said lateral lace support and said medial lace support, said lateral lace support and said medial lace support each including a single, opening between said top edges and said bottom edges; and said first connecting tabs of said upper and said second connecting tabs of said lateral and medial lace supports are alternatingly arranged along the lateral and medial sides of said upper; and a lace threaded through said first lace openings of said first connecting tabs and said second lace openings of said second connecting tabs to secure said lace to said upper, wherein after said lace is secured to said upper and said lateral and medial lace supports, a first longitudinal axis extending between said lateral lace support and said medial lace support and through all points where said lace crosses over itself, is offset from a second longitudinal axis extending between a medial side and a lateral side of said sole and along a center of gravity of a user's foot.

6. The article of footwear of claim 5, wherein at least one of said first connecting tabs includes a plurality of said first lace openings.

7. The article of footwear of claim 5, wherein the top edge and the bottom edge of said lateral and medial lace supports are not parallel to each other.

8. The article of footwear of claim 5, wherein said lateral lace support and said medial lace support are each formed by three material layers.

* * * * *